United States Patent [19]

Roddy

[11] 4,396,195

[45] Aug. 2, 1983

[54] BOARD GAME APPARATUS

[76] Inventor: Kenneth A. Roddy, 15322 E. Ritter Cir., Houston, Tex. 77071

[21] Appl. No.: 205,337

[22] Filed: Nov. 10, 1980

[51] Int. Cl.[3] ..... A63F 3/00

[52] U.S. Cl. ..... 273/251

[58] Field of Search ..... 273/243, 248, 249, 251

[56] References Cited

U.S. PATENT DOCUMENTS

| | | | |
|---|---|---|---|
| 1,552,254 | 9/1925 | White | 273/249 |
| 2,128,608 | 8/1938 | Goertmiller | 273/251 |
| 3,734,508 | 5/1973 | Snyder | 273/249 |
| 3,759,520 | 9/1973 | Straitwell | 273/243 |
| 3,889,954 | 6/1975 | Masilow | 273/256 |

FOREIGN PATENT DOCUMENTS

| | | | |
|---|---|---|---|
| 1266949 | 5/1972 | United Kingdom | 273/251 |

*Primary Examiner*—Richard J. Apley
*Assistant Examiner*—David J. Brown
*Attorney, Agent, or Firm*—Neal J. Mosely

[57] ABSTRACT

A board game designed on a "Renaissance" theme wherein the object is to become the first player to reach the finish point (the Castle) as a result of winning a series of contests and challenges. The game includes a gameboard having a playing surface with a path of travel, a playing piece for each player of the game, a plurality of instruction cards, a chance device for determining the movement of the playing piece along said path and at least one simulated coin for determining the winner or loser of a contest or challenge. The path has a plurality of stations including contest stations having indicia representative of a contest or event whereby one player may challenge another player, and a plurality of stations having indicia representative of a location that when occupied by the playing pieces of two players allows the second player to challenge the first for the right to remain on the station. The winner of a challenge is determined by one player matching a coin with his opponent. At opposite ends of the path, there is a starting station and a finish station. The path is provided with a plurality of stations having indicia representative of a hazard whereby any playing piece landing thereon must return to the starting station. A plurality of instruction stations are positioned along the path directing that the player of any playing piece landing thereon pick a card from a set of instruction cards.

1 Claim, 6 Drawing Figures

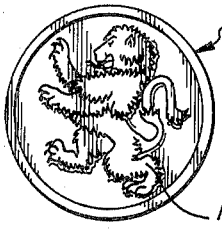
fig.2A
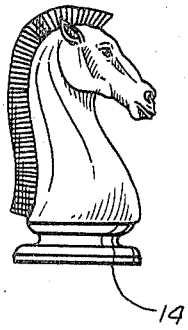
fig.3
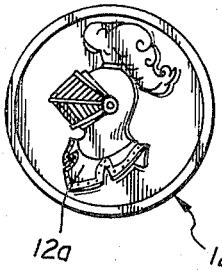
fig.2B
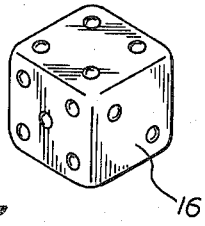
fig.4
fig.5
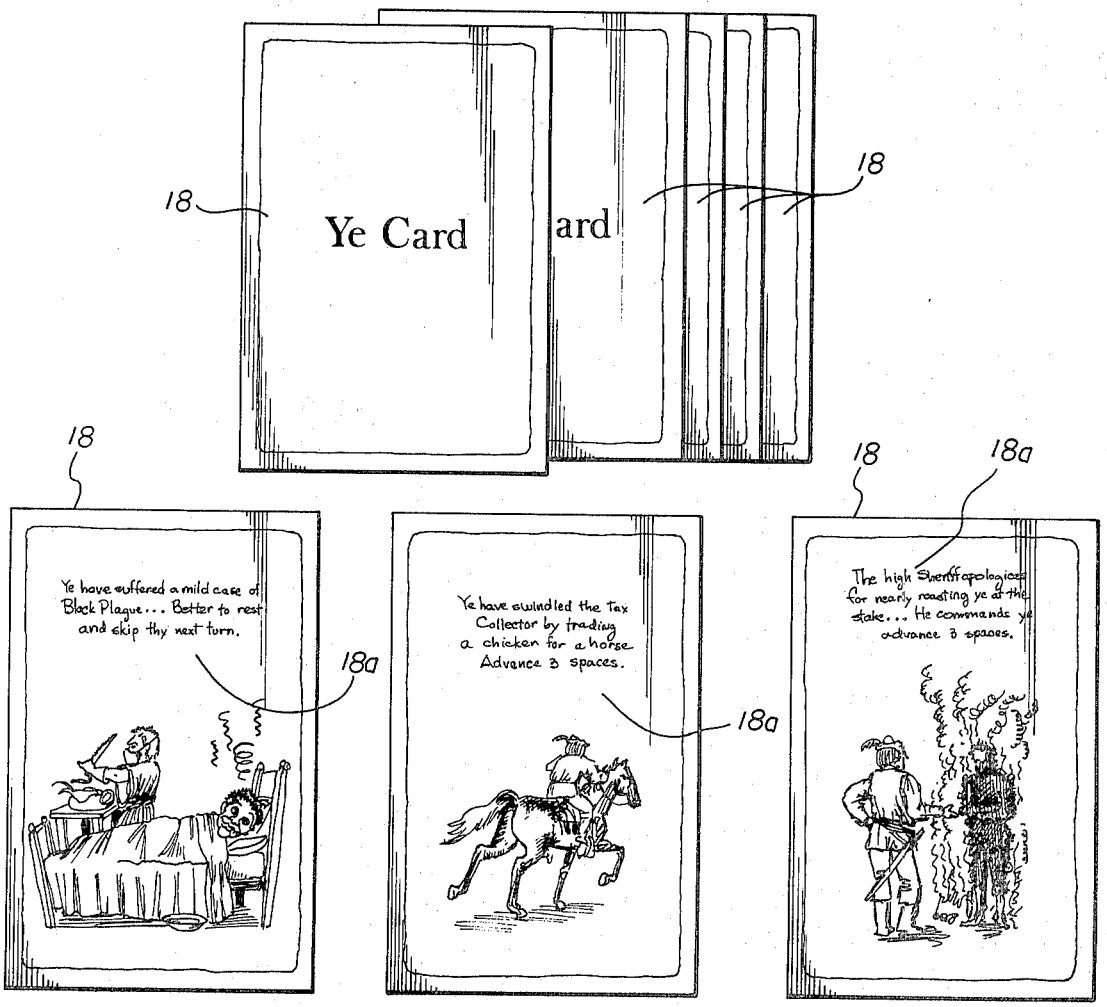

BOARD GAME APPARATUS

BACKGROUND OF THE INVENTION

1. Field of the Invention

This invention relates to new and useful improvements in the field of board games and more particularly to board games having a path for movement of playing pieces according to selected instructions for play.

2. Brief Description of the Prior Art

In the prior art there have been many board games using dice where chance and skill such as bargaining and competition come into play.

Anderson U.S. Pat. No. 3,531,121 discloses a game board in which show ring competition is simulated.

Roth U.S. Pat. No. 4,089,527 illustrates a board game involving a contest of memorization.

Barry U.S. Pat. No. 4,093,235 discloses a game that involves a contest of memorization and is intended to educate the players with respect to tourist attractions.

There do not appear to be any board games wherein one player may selectively challenge another player to a contest whereby the winner of the contest or challenge is determined by correctly predicting the outcome of matching coins.

SUMMARY OF THE INVENTION

One of the objects of this invention is to provide a board game wherein one player may selectively challenge another player.

Another object of the invention is to provide a board game wherein the winner of a contest or challenge is determined by correctly predicting the outcome of matching coins.

Still another object of the invention is to provide a board game wherein the winner of a contest or challenge remains at one location or moves forward and the loser moves backward.

A further object of the invention is to provide a board game based on a Renaissance theme.

A still further object of this invention is to provide a new and entertaining board game based on a Renaissance theme involving a series of contests and challenges.

Other objects of this invention will become apparent from time to time throughout the specification and claims as hereinafter related.

These and other objects of the invention are accomplished in one preferred embodiment which provides a gameboard having a playing surface with a playing path, a plurality of playing pieces, at least one for each player of the game, a chance device determining the extent of movement of the playing pieces on the gameboard, a set of instruction cards and at least one simulated coin used to determine the winner and loser of a contest or challenge. The playing surface has a plurality of stations arranged so as to form a playing piece path of travel.

In a preferred embodiment of the invention, the playing path includes a starting station and a finish station. The playing path also includes contest stations having indicia representative of contests or events whereby a player may selectively challenge another player. Challenge stations are provided at selected locations having indicia representative of a location that when occupied by the playing pieces of two players allows the second player to challenge the first for the right to remain on the location. Stations are located along the playing path having indicia representative of a hazard whereby a player whose playing piece lands thereon must return his piece to the starting station. The path further includes stations having indicia instructing a player whose playing piece lands thereon to pick a card from a set of instruction cards.

BRIEF DESCRIPTION OF THE DRAWINGS

FIG. 2*a* is a front view of one side of a simulated coin used in competition in the present invention.

FIG. 2*b* is the reverse side of the simulated coin shown in FIG. 2*a*.

FIG. 3 is a side view of a playing piece used in the present invention.

FIG. 4 is a perspective view of a chance device used in the present invention; and FIG. 5 is a plan view of representative cards of a set of instruction cards employed in the present invention.

DESCRIPTION OF THE PREFERRED EMBODIMENT

Figure 1:
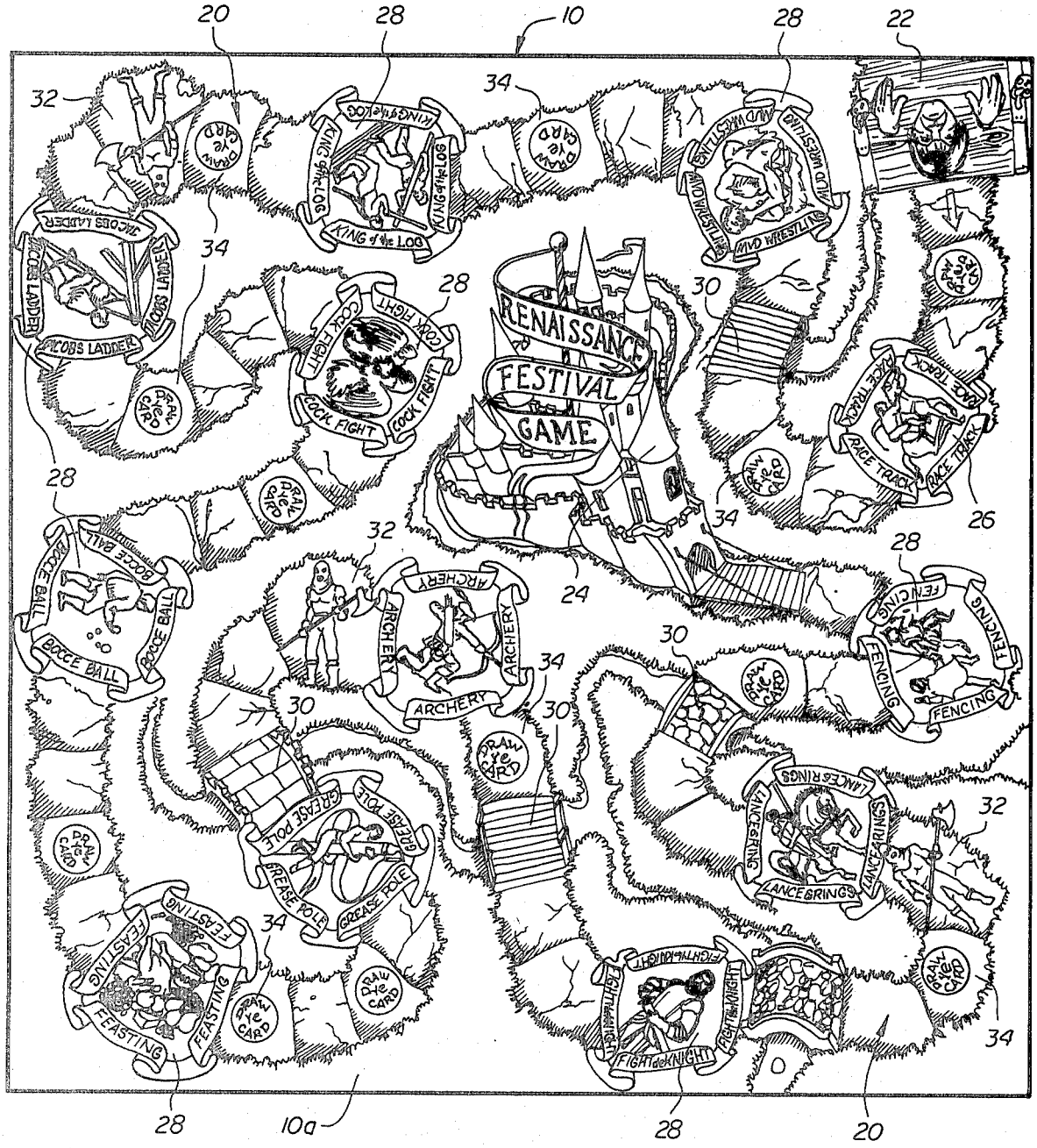
FIG. 1 is a plan view of a preferred embodiment of the gameboard of this invention, entitled "Renaissance Festival Game"

"Renaissance Festivals" or "Renaissance Fairs" are held periodically in many regions of the United States and other countries and have become very popular. The present invention takes advantage of the popularity of such events by providing a board game which relates to the life style and sporting events that were popular during the Renaissance period. A board game of this type provides a popular and well accepted means for the promotion and advertising of these events.

The board game of the present invention is a race type game based on a Renaissance theme using contests and challenges as a means of advancing or restricting movement toward a common goal (the Castle). The game includes a gameboard generally designated 10 (FIG. 1). A simulated coin 12 (FIGS. 2*a* and 2*b*) having distinctive sides 12*a* and 12*b* is provided for each player of the game. A playing piece 14 (FIG. 3) is also provided for each player. A chance device in the form of a single die 16 (FIG. 4) is provided for use by the players according to the rules of the game as set forth below. A set of instruction cards 18 (FIG. 5) is also provided for use by the players when their playing pieces occupy selected stations or areas of the playing board.

The gameboard 10 has a flat surface 10*a* upon which is illustrated a playing piece path of travel generally designated 20. The playing path 20 includes a plurality of stations having a variety of functions in the game as set forth below. The stations include a start station 22 (Stocks), a finish station 24 (Castle), and a plurality of other stations at selected places along the path. A Race Track station 26 is the first station encountered along the path.

A plurality of Contest stations 28 are provided for competitive action in the game. Each Contest station 28 has indicia, graphics and artwork that is representative of contests and events that were popular during the Renaissance period, e.g., Archery, Bocce Ball, Fencing, King of the Log, Jacobs Ladder, etc. The Contest stations 28 allow one player to challenge any player of his choice to a Contest which will be further described in the rules of the game.

A plurality of Challenge stations 30 (Bridges) are provided along playing path 20 which, if occupied by the playing piece of one player, allows the second player whose playing piece lands on that station to challenge the first for the right to remain on that station.

The path 20 also includes a plurality of Hazard stations 32 (Executioner) having graphics and indicia representative of a hazard. Any player whose playing piece 14 lands on a Hazard station 32 must return his playing piece to the start station 22 (Stocks) and forfeit one turn before advancing again.

Instruction stations 34 (Draw Ye Card) are provided at selected points along the playing path 20 having indicia instructing the player whose playing piece 14 lands thereon to pick a card from the set of instruction cards 18.

In FIG. 2*a* and FIG. 2*b*, it is seen that the coin 12 has two distinctly different symbols on the front and back sides thereof. For example, on one side a helmet 12*a* (FIG. 2*a*) and on the reverse side a lion 12*b* (FIG. 2*b*). The coin 12 is employed to determine the winner and loser of a particular contest or challenge.

In FIG. 5, it can be seen that the instruction cards 18 have indicia and graphics 18*a* thereon, instructing the players drawing such cards to take a particular action, e.g., advance a number of spaces, go back a number of spaces, miss a turn or receive an extra turn. The cards 18 are also used to periodically group all the players in the same location.

PLAY OF THE GAME

To play the game, each player picks a playing piece 14 which is distinguishable from the other playing pieces in either color or shape and each player is given a simulated coin 12 to start the game. The instruction cards 18 are shuffled and placed face down beside the board 10. All players place their playing pieces 10 on the start station 22 (Stocks) and each, in turn, throws the die 16. The player having thrown the highest number moves his playing piece first and the order of play continues in a clock-wise rotation. Players move their playing pieces 14 along the path 20 the number of spaces indicated by the die 16.

If the playing piece of any player lands on the Race Track station 26, all players must move their playing pieces 14 to that station (even if they are in the Stocks). The players, each in turn, throw the die 16 and move forward from station 26 the number of spaces indicated.

Any player whose playing piece 14 lands on an Instruction station 34 (Draw Ye Card) must take the top one of the Instruction cards 18. Such player must follow the instructions on the selected card and then replace it at the bottom of the stack.

Whenever a player has his playing piece land on a Contest station 28 (Jacobs Ladder, Fencing, etc.) he must challenge any other player of his choice to a contest. The player being challenged must move his playing piece 14 to that contest. Both players flip their coin 12 and the challenger (1st player) must call "ODD or EVEN". ODD means that the symbols on the coins 12 do not match. EVEN means that the symbols do match. The winner of the toss throws the die 16 and moves his playing piece 14 forward the number of spaces indicated. The loser throws the die and moves his playing piece backward the number of spaces indicated. If either player lands on another Contest station 28 as a result of a challenge, the station is treated as a regular, i.e., undesignated, space or station and no contest is held.

If player has his playing piece 14 land on a Challenge station 30 (bridge) that is occupied by an opponent's playing piece, that player must challenge the occupant. The challenge requires both players to flip a coin 12. The challenger (2nd player to land on bridge) must call "ODD or EVEN". The winner of the toss remains on the Bridge 30 and the loser throws the die 16 and moves backward the number of spaces indicated. If a playing piece lands on an occupied Challenge station 30 (Bridge) as a result of another challenge or contest, such station is considered undesignated and no challenge is held.

Any player whose playing piece 14 lands on a Harzard station 32 (Executioner) must immediately return such playing piece to the Start station 22 (Stocks) and forfeit one turn before moving out again.

The first player whose playing piece 14 enters the Finish station 24 (castle) wins the game. However, in the final move, the player must throw the exact number of spaces for his playing piece 14 to enter the Finish station 24 (Castle). If a player thows more than the required number to enter the Castle, that player must go back the number of spaces by which the move to the finish station 24 was exceeded. For example, if a 4 is needed to win and a 6 is thrown, then the player must advance 4 and go back 2 spaces.

Various strategies can be employed in the play of the game. For example, if a player is near the Finish station (Castle) and another player is in the Start station (Stocks) the player near the finish may want to challenge the other player to protect himself from being taken back and challenged near the start. In most cases, the player behind would want to challenge the player in the lead.

Having described a preferred embodiment of the board game of this invention, it should now become apparent that there are numerous modifications and different versions of the board game, all of which are contemplated as falling within the scope of this invention. For example, the path 20 may be delineated as a spiral configuration or any other design which lends itself to having a common start and finish. The game could also be printed on wood or plastic or on a simulated leather material. The playing pieces could optionally be stones or pebbles to lend character to the game and be more representative of the Renaissance period. Another version of the game may be played for money where gambling is not prohibited by law. In that version, a player would place a poker chip or sum of money into the Castle each time he lost a contest or challenge, and the first player to enter the Castle would receive the reward.

I claim:

1. A board game comprising a gameboard having a playing surface thereon;

a plurality of playing pieces for movement on said playing surface;

a chance device for determining the extent of movement of said playing pieces on said playing surface;

a set of instruction cards each having indicia directing a beneficial or detrimental action to be taken by the player drawing a card during play;

a plurality of stations on said playing surface defining a path of travel for said playing pieces;

one of said stations having indicia representing a start station and another station representing a finish station;

a plurality of said stations along said path of travel having indicia representative of contests or events whereby one player may selectively challenge any other player to a contest;

a plurality of said stations along said path of travel having indicia representative of a location which when occupied by the playing piece of a first player allows the second player whose playing piece lands on said location to challenge the first player for the right to remain on said location whereby each player has an equal chance of remaining or being set back a number of spaces;

a plurality of said stations along said path of travel having indicia instructing a player whose playing piece lands thereon to pick a card from said set of instruction cards and to play in accordance with the indicia thereon;

a plurality of said stations along said path of travel having indicia representative of a hazard whereby a player whose playing piece lands thereon must return to said start station;

means used for resolving a contest or challenge for determining which of said playing pieces will remain on a contest or challenge station or move in a forward direction and which of said playing pieces will move in a backward direction along said path of travel whereby each participant has an equal chance of winning or losing said contest or challenge;

said contest or challenge resolving means comprises one or more simulated coins having distinctly different symbols on the front and back sides thereof; and at least one station along said path of travel for grouping all players at random times having indicia requiring all playing pieces to move to said station whenever any one playing piece stops on said station and further requiring that all playing pieces move competitively from said station.

* * * * *